US007681276B2

(12) United States Patent
Rothweil et al.

(10) Patent No.: US 7,681,276 B2
(45) Date of Patent: Mar. 23, 2010

(54) CLEANING IMPLEMENTS HAVING MAGNETIC MEANS

(75) Inventors: David Anthony Rothweil, Poway, CA (US); Daniel Anthony Rothweil, Poway, CA (US)

(73) Assignee: D-Squared Product Development, Poway, CA (US)

( * ) Notice: Subject to any disclaimer, the term of this patent is extended or adjusted under 35 U.S.C. 154(b) by 701 days.

(21) Appl. No.: 11/488,476

(22) Filed: Jul. 18, 2006

(65) Prior Publication Data

US 2006/0260083 A1 Nov. 23, 2006

Related U.S. Application Data

(63) Continuation-in-part of application No. 11/007,406, filed on Dec. 8, 2004, now abandoned.

(60) Provisional application No. 60/589,387, filed on Jul. 20, 2004.

(51) Int. Cl.
*A47L 13/10* (2006.01)

(52) U.S. Cl. ..... 15/210.1; 15/228; 15/231; 209/215

(58) Field of Classification Search ..... 15/228, 15/231, 1.51, 1.52, 220.2, 210.1, 209.1; 209/215
See application file for complete search history.

(56) References Cited

U.S. PATENT DOCUMENTS

| | | | | |
|---|---|---|---|---|
| 2,634,444 | A * | 4/1953 | Coleman | 15/220.2 |
| 4,658,461 | A * | 4/1987 | Roe et al. | 15/210.1 |
| 4,991,250 | A * | 2/1991 | Young | 15/228 |
| 5,395,148 | A * | 3/1995 | Jameson et al. | 294/65.5 |
| 5,815,878 | A * | 10/1998 | Murakami et al. | 15/231 |
| 6,305,046 | B1 * | 10/2001 | Kingry et al. | 15/231 |
| 2004/0194245 | A1 * | 10/2004 | Lee | 15/229.4 |
| 2005/0104696 | A1 * | 5/2005 | Pestone | 335/207 |

* cited by examiner

*Primary Examiner*—Laura C Guidotti
(74) *Attorney, Agent, or Firm*—The Nath Law Group; David B. Waller, Agent

(57) ABSTRACT

The present invention is a device for cleaning surfaces comprising; a housing having a handle on one end and a cleaning head on the other end the cleaning head having an upper surface, a lower surface, a perimeter edge and a magnetic means. The magnetic means is removably attached to the cleaning head and provides a magnetic field to its lower surface. There is at least one attachment means provided on the upper surface or the perimeter for securing a cleaning sheet over the lower surface of the cleaning head.

12 Claims, 3 Drawing Sheets

CLEANING IMPLEMENTS HAVING MAGNETIC MEANS

CROSS-REFERENCE TO RELATED APPLICATIONS

This application is a continuation-in-part of patent application Ser. No. 11/007,406 filed 8 Dec. 2004 now abandoned and a continuation-in-part application of patent application Ser. No. 60/589,387 filed 20 Jul. 2004.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION

1. Field of Invention

This invention relates to devices used in cleaning. More particularly, to dusting or sweeping devices that use magnetism to assist in collecting dust or dirt that is susceptible to a magnetic field.

2. Description of Related Art

A number of devices have been used over the centuries to remove unwanted dust and dirt particles from surfaces both inside and out. Brooms were developed long ago and were generally composed of a bundle of firm sticks or fibers bound together onto a long handle for brushing or sweeping dirt and other unwanted items from a surface. Unfortunately, not all items that impact the floor could be swept or brushed away.

Mops were designed to provide soap and water or a cleaning solution to the floor for removing organic materials. Mops have been used over the past few centuries and are generally composed of absorbent rope or twine bundled together and affixed to a long handle. While the mop has been effective in removing unwanted organic matter from floor the surface must be allowed to dry prior to use to prevent potential injury from slipping and/or falling.

Recent innovations in cleaning devices have lead to the development of the dust mop such as those described in U.S. Pat. Nos. 5,815,878 and 6,305,046. The dust mop was designed to clean smooth surfaces such as tile and wood floors. They have also been adapted for use on furniture, such as tables, cabinets, or counters as handheld dusters. The dust mop usually has a handle attached to a cleaning head with a flat surface on which a cleaning sheet or cloth is secured. This construction has the advantage of performing the functions of both a broom and a mop simultaneously. The cleaning sheet acts like a broom pushing and aggregating dirt and dust as it is drawn over a surface. The chemicals provided on the cleaning sheet dissolve and remove unwanted organic matter from the surface as the head is passed over the affected area. Unfortunately, these dust mops are limited on the volume and size of the particles they are able to capture and remove from a surface. The size limitations are generally a factor of the cleaning sheet weave and the static charge provided on the sheet surface. Particles not captures by the cleaning sheet may be too heavy to be removed from the surface or simply too large.

Consequently, there is a need for a dust mop that functions to remove dust and dirt from a surface like a broom, is able to dissolve or remove organic matter from a surface like a mop and has the ability to remove heavy and/or larger particles from a surface that other commercially available mops are unable to remove.

BRIEF SUMMARY OF THE INVENTION

In accordance with the present invention a device for cleaning surfaces is provided comprising; a housing having a handle on one end and a cleaning head on the other end the cleaning head having an upper surface, a lower surface, a perimeter edge and a magnetic means, the magnetic means being removably attached to the cleaning head and providing a magnetic field to at least its lower surface and at least one attachment means provided on the upper surface or the perimeter for securing a cleaning sheet over the lower surface of the cleaning head.

In another aspect of the present invention a device for cleaning surfaces is provided comprising; a handle, a cleaning head attached to the handle, the cleaning head having an upper surface, a lower surface, and a perimeter edge, a magnetic means removably encased within said cleaning head or pivotally attached on its upper surface and providing a magnetic field to at least the lower surface of the cleaning head and at least one attachment means provided on the upper surface or the perimeter for securing a cleaning sheet over the lower surface of the cleaning head.

In one embodiment of the present invention the magnetic means is at least one rigid magnet or a flexible magnetic sheet. Preferably the at least one rigid magnet is pivotally or hingeably attached to the upper surface of the cleaning head. Alternatively, the magnetic means is a flexible magnetic sheet removably encased within the cleaning head and adjacent to the lower surface. In addition the magnetic means may be affixed to the lower surface of the head by an adhesive that allows the magnetic means to be removed and replaced.

In another embodiment the housing may further comprise a flexible means between the handle and the cleaning head that allows the cleaning head to pivot about the handle. Preferably the flexible means comprises a universal joint and a rotational joint.

In yet another embodiment the attachment means functions by way of direct pressure. In this configuration it is preferable that the attachment means is at least one clamp. Most preferably the clamp is activated by a spring or magnet. In another configuration the attachment means may function by way of frictional pressure. In this configuration the attachment means is a serrated strip, at least one pressure grip or Velcro™. In yet another embodiment the attachment means functions by mechanical pressure. In this configuration it is preferable that the attachment means be one or more snaps.

DETAILED DESCRIPTION OF THE INVENTION

Figure 1:
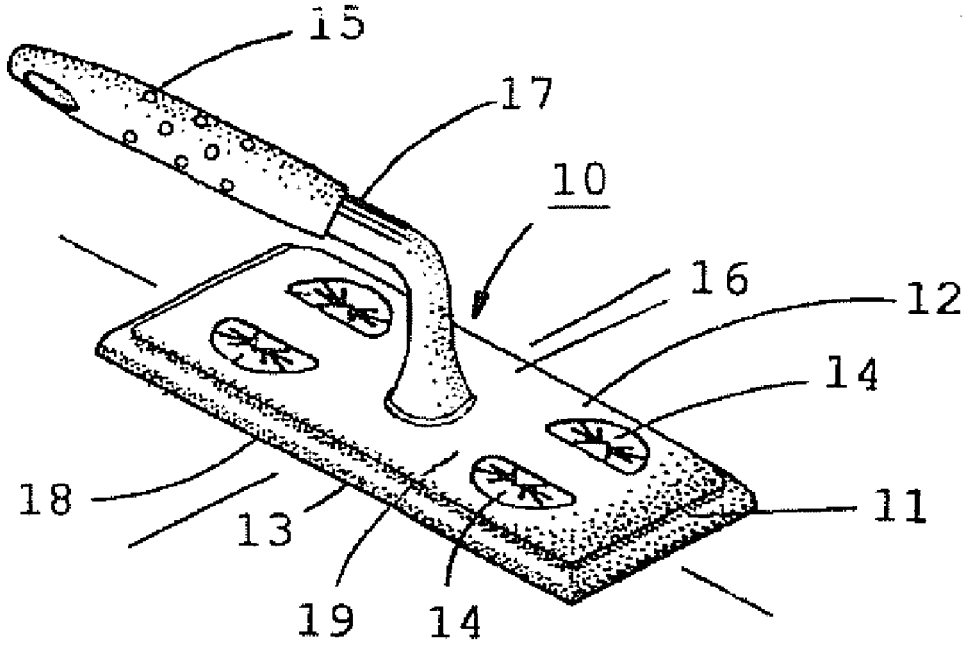
FIG. 1 is a perspective view of one preferred handheld duster of the present invention having pressure grips for affixing a cleaning sheet on the top surface of the cleaning head.

Unless defined otherwise, all terms used herein have the same meaning as are commonly understood by one of skill in the art to which this invention belongs. All patents, patent applications and publications referred to throughout the disclosure herein are incorporated by reference in their entirety. In the event that there is a plurality of definitions for a term herein, those in this section prevail.

The term "attachment means" as used herein refers to a means for securely, yet reversibly affixing a cleaning sheet the cleaning head of the device by a variety of methods by a variety of methods such as for example one or more press grip such as that described in U.S. Pat. No. 6,305,046, one or more snaps, one or more magnets or one or more clamps.

The term "housing" as used herein refers to the main body of the device in any shape or configuration that provides the structure of a head on one end and a handle on the other in a single unit. The housing may be provided in a variety of configurations ranging from a relatively short configuration to an elongated configuration. For example, the housing might have a short handle integral to the upper surface of the cleaning head wherein the handle is generally parallel to the length of the cleaning head and may extend beyond the perimeter of the cleaning head. Alternatively, the housing may be long having a handle on one end and a cleaning head on the other, both integral to an elongated shaft portion.

The term "head" or "cleaning head" as used herein refers to a structural element of the invention that provides a lower surface that interfaces with the surface to be cleaned for affixing a cleaning sheet. The cleaning head may have a flat lower surface such as would be preferred for a floor or tabletop. Correspondingly, the surface of the cleaning head may conform to the surface intended to be cleaned. For example, if the cleaning head is used to clean baseboard molding in a home it may have a lower surface that conforms to the routed or milled surface to increase the ease and effectiveness of cleaning.

The term "magnetic means" as used herein refers to any means by which a magnetic field, B field, may be generated or maintained during the normal use of the device. A magnetic field may be generated by using permanent magnets or by an electromagnet wherein the field is generated by passing electricity through a coil of wire. Examples of permanent magnets that may be utilized with the present invention include rigid or rare earth metal magnets available commercially in a variety of shapes and strengths or flexible magnetic sheets that may be conformed to the topography of a surface.

The term "flexible means" as used herein refers to a means for connecting two elements of the invention in a way that allows some movement of one or both elements with respect to one another. For example, a flexible means could be a hinge, a joint or bendable portion either affixed to or created on one or both elements. Such a bendable portion may be provided for example, by connecting the head to the handle via a short shaft made of bendable material such as rubber or by connecting both elements by a tightly coiled spring.

The term "pressure grip" as used herein refers to an attachment means that functions by way of friction to snag and then grip a cleaning sheet securely holding the sheet against the cleaning surface of the cleaning head. For example, one such pressure grip is disclosed in U.S. Pat. No. 6,305,046.

The term "fiber matrix" as used herein refers to a fibrous material that may be used to prepare a cleaning sheet such as for example, cotton or polyester. The fiber matrix may be woven, non-woven or may be provided by forming operations using melted materials such as spunbonded, meltblown or air-through bonded.

The term "cleaning solution" as used herein refers to a chemical composition that may be applied to a cleaning sheet, or in which a cleaning sheet may be dipped, that assists in the capture, collection and/or aggregation of dust and/or dirt, onto or by, the sheet during use with the device of the present invention.

The housing may be prepared having both a head portion and a handle portion within the same element. This configuration may be achieved by form molding plastic into a single unit having a head on one end and a handle on the other. Alternatively, the housing may be constructed to provide a head to which a handle may be attached or affixed. The housing may provide an elongated body separating the head and handle in such a way that the device allows the user to clean items at a distance such as the floor. In another configuration the body is truncated wherein the distance between the head and the handle is relatively short creating a device that may be used to clean items closer to the user such as a table or counter. Other configurations having intermediate lengths may be provided based on the specific needs of the user. In addition, a variety of lengths may be provided in one device by configuring the housing to have a telescoping or an adjustable length between the head and the handle. Telescoping capability may be provided by tubular rods of desired lengths having diameters that allow one to fit into the other with a securing means at locations where the rods intersect. Devices having similar telescoping capabilities are commercially available such as walking sticks sold by outdoor equipment companies. These devices typically have one or more connector clamps that secure the rods in place at desired lengths by twisting the rods in opposite directions on either end of the connector. Alternatively a number of rods may be provided that may be fastened together by screw joints to achieve a desired length.

The elongated body may also be provided in a general linear form of may have one of more bends that create desired angles for cleaning specific items. For example, if the user would like to clean the veins of a ceiling fan it would be beneficial to angle the head such that its cleaning surface meets the surface to be cleaned. This may be achieved by bending the elongated body nearer to and including the head into a U-shape. Further the handle may be bent perpendicular to the U-shaped body forming the shape of a large hook. In this configuration the user is able to hook the head over the vein with the head flush against the upper surface of the vein. The surface is then dusted by drawing the head outward from the center of the ceiling fan applying sufficient pressure to maintain the cleaning surface on the top of the vein. These bends may be provided by form molding the body into the desired shape. Alternatively, if the handle and cleaning head are not prepared as a single unit, one or more handles may be provided having desired shapes and lengths for the users particular cleaning needs that may be affixed to head prior to use.

A variety of configurations of the housing can be envisioned base on the present invention. For example, a handheld dusting device of the present invention can be configured to provide a cleaning head and a relatively short handle, see FIG. 1. In this aspect of the invention the housing 12 comprises a head 19 and a handle 17. The head 19 having an upper surface 16, a lower surface 18 and a perimeter edge 11, may be provided in a number of shapes based on the desires of the user, for example the head 19 may be rectangular, square, oval, round, egg-shaped or any combination, of any or all, of these shapes. Preferably the head 19 is provided in a generally rectangular shape, having a length of about 6 inches to about 36 inches, a width of about 2 inches to about 10 inches and a thickness of about ¼ inch to about 2 inches. The handle 17 may be provided in a variety of shapes, such as for example the cross-section of the handle 17 may be circular, oval, triangular or square. The length of the handle 17 may be from about 3 inches to about 24 inches having a diameter or width of about ½ inch to about 1½ inches. The handle 17 may be provided in tubular form or in solid rod form. One skilled in the art would recognize that rigidity of the handle 17 is necessary for effective use, consequently, if the handle 17 is made of solid stock it may have a diameter or width that is less than the diameter or width of the tubular stock. Correspondingly, if the handle 17 is provided in tubular form the thickness of the stock material will be thicker for narrower diameter or width stock to maintain rigidity. Alternatively, the thickness of the tubular stock may be thinner if the diameter or width is larger. Preferably the handle 17 is tubular having a cylindrical shape of diameter about 1 inch and a thickness of about 1/32 to about 3/16. The handle 17 may also be provided in a variety of shapes based on the needs of the user such as for example a hook shape for cleaning the veins of a ceiling fan. It may be extend from one or more perimeter edges of the head or may extend from the upper non-cleaning surface of the head 16. The handle 17 is provided as a gripping element for securely holding and manipulating the device. The handle 17 may be provided as a projection extending from the head 19 at a length sufficient for the width of a hand or may be provided with an extended length to position the head 19 at a desired distance from the user.

When the handle 17 is provided in shorter lengths, such as between about 3 inches to about 12 inches it may extend from the upper surface of the head 16 at a desired angle such as for example, 90 degrees, 45 degrees or 30 degrees generally parallel to or generally perpendicular to the heads longest dimension. Alternatively, the handle 17 may have a curved portion that allows the handle 17 to be positioned parallel to the upper surface of the head 16. For example as the handle 17 extends from the upper surface of the head 16 about 2 inches to about 3 inches it bends or curves at 90 degrees positioning the grippable portion of the handle parallel with the upper surface of the head 16.

At longer lengths the handle 17 may have one or more bends or curves depending on the needs of the user. As discussed previously, the device of the present invention may be configured for use in cleaning the veins of a ceiling fan. In this configuration the length of the head 19 is about 1 to 3 times the width of the vein. The handle 17 extends from the upper surface 16 or perimeter edge 11 of the head generally parallel to the upper surface 16 for a distance of about 3 inches to about 6 inches, or about the width of the vein, then curves forming a U-shape. The width of the U being about 5 to 50 times the thickness of the vein so that the device 10 may be easily positioned for cleaning. The handle 17 is then bent at about a 90-degree angle to, and in line with, the U curve. The length of this portion of the handle 17 may vary depending on the height of the ceiling fan above the user.

A grippable portion 15 may be provided on the handle 17. This portion may be molded to conform to the contour of a closed hand for ease of use. In the elongated configuration the molded contour grip may be provided on one end of the handle 17 and the head 19 positioned on the other end. Correspondingly the grippable portion 15 may be made of a flexible material that when gripped conforms to the hand of the user.

In another configuration a floor mop is provided comprising a cleaning head and an elongated handle. In this aspect of the invention the head is provided similarly to that discussed for the duster. The handle may be provided in a length of from 2 feet to 6 feet and preferably extends from the upper non-cleaning surface of the head and more particularly about the center of the upper surface. The handle may be adjustable but is preferably static having a length of about 3 feet to about 4 feet. For ease of use it is also preferable to have a flexible means between the head and the handle. The flexible means may be provided by narrowing the elongated handle just above the upper surface of the head in such a way to allow the head to bend at an angle keeping the cleaning surface flush with the floor during use. For example if the elongated handle is provided with a groove parallel to the front edge of the head narrowing the shaft so that the handle may bend keeping the head flush with the floor during use. This configuration of the flexible means provides a tilting capability to the handle with respect to the head in a single direction, such as side to side or forward to back. In another configuration the flexible means is prepared by narrowing the shaft in at least two positions in close proximity. One narrowing is provided parallel to the front edge of the head and the second is provided perpendicular to the front edge of the head. The narrowed connection regions are positioned about the center of the handle shaft separated by a region of the shaft having a length of about 1/16 to about ⅛ inch. These alternating direction narrowed connection regions may be repeated one or more times to enhance the ease of flexibility. This method is known and has been used for providing flexibility of flat surface painting sponges between the head and handle.

In another aspect of the invention the head and handle are provided separately and connected prior to use. In this configuration the head and the handle may be made of different materials that confer desired characteristics to the elements. For example, the handle may be made of metal or wood to maintain rigidity and the head may be made of polymer such as form molded plastic to prevent scratching of the surfaces being cleaned. Further the handle may comprise a gripping means that is affixed to the end opposite the head. The gripping means may be made of a compressible polymer such as rubber to conform to the user's hand. Alternatively the gripping means may be made of plastic wherein the surface of the grip is provided with a texture, or molded in a shape, that enhances the user's ability to grip the device. The gripping means may be affixed to the handle by a variety of methods such as for example pressure fitting over the end of the handle, by forming the gripping means in two halves that are clamped about the handle, by for example screws, or may be adhered to the handle with adhesive. If the handle is short in length such as in a duster configuration, it may have a single gripping means, correspondingly, if the handle is longer such as in a mop configuration, see FIG. 2, there may be more than one gripping means 27. For example, one gripping means 27 may be positioned on the end of the handle 22 farthest from the cleaning head 24 and another gripping means 27 positioned about midway between the cleaning head 24 and the end of the handle 22. In this configuration the user may grip the handle using both hands.

In the handheld duster device configuration of the present invention the handle may be affixed or connected to the head permanently by for example adhesive or welding, or may be affixed reversibly by for example screw joint or snapping into place. Alternatively, the handle may be connected to the cleaning head by a rotatable connection that allows the head to rotate about the handle. Correspondingly the handle may be connected to the head by a hinge to allow the head to tilt about the handle. Preferably the handle is affixed or connected to the head rigidly allowing more control during use. If affixed rotatably the head preferably locks into one of a variety of available positions prior to use.

Figure 2:
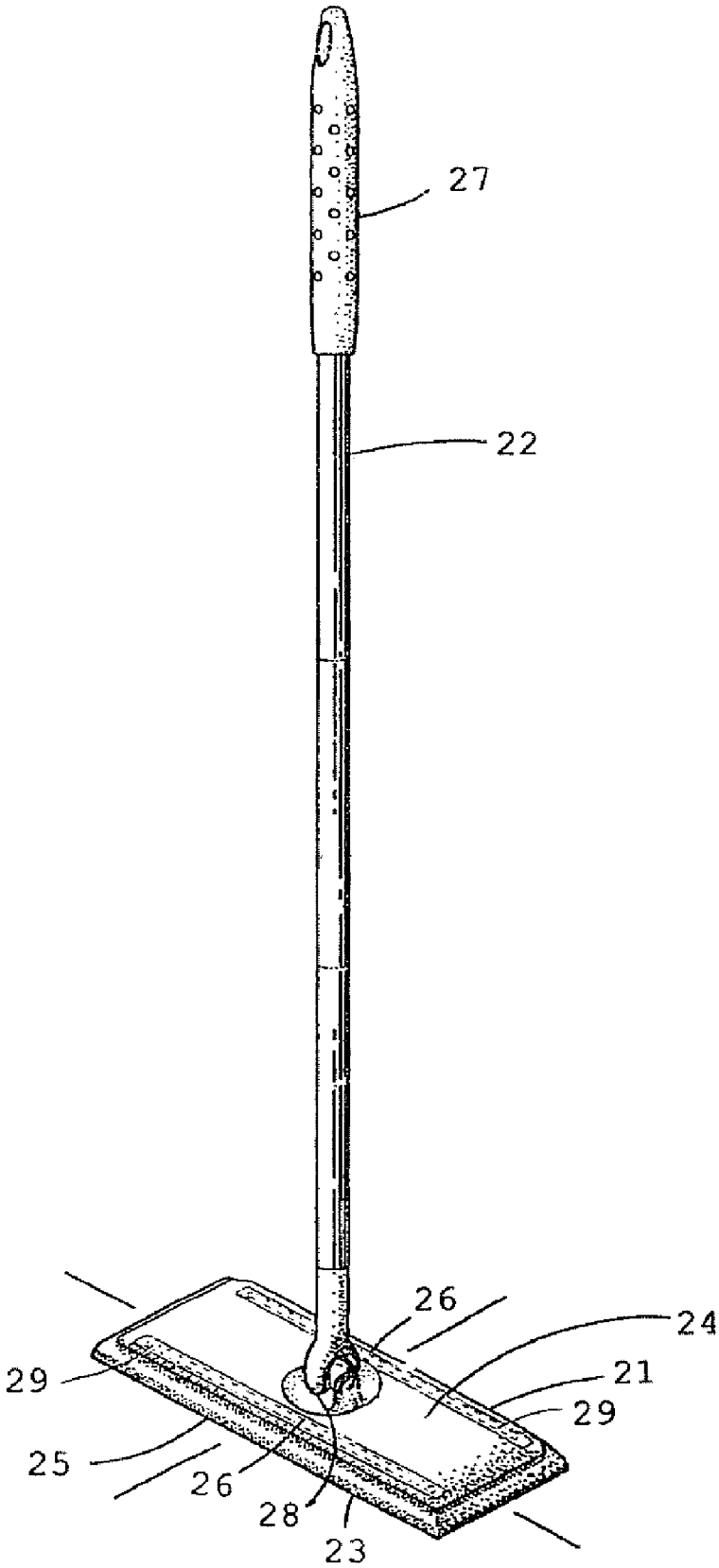
FIG. 2 is a perspective view of one preferred duster floor mop of the present invention having a magnet clamp for affixing a cleaning sheet on the perimeter edge of the cleaning head.
Figure 3A:
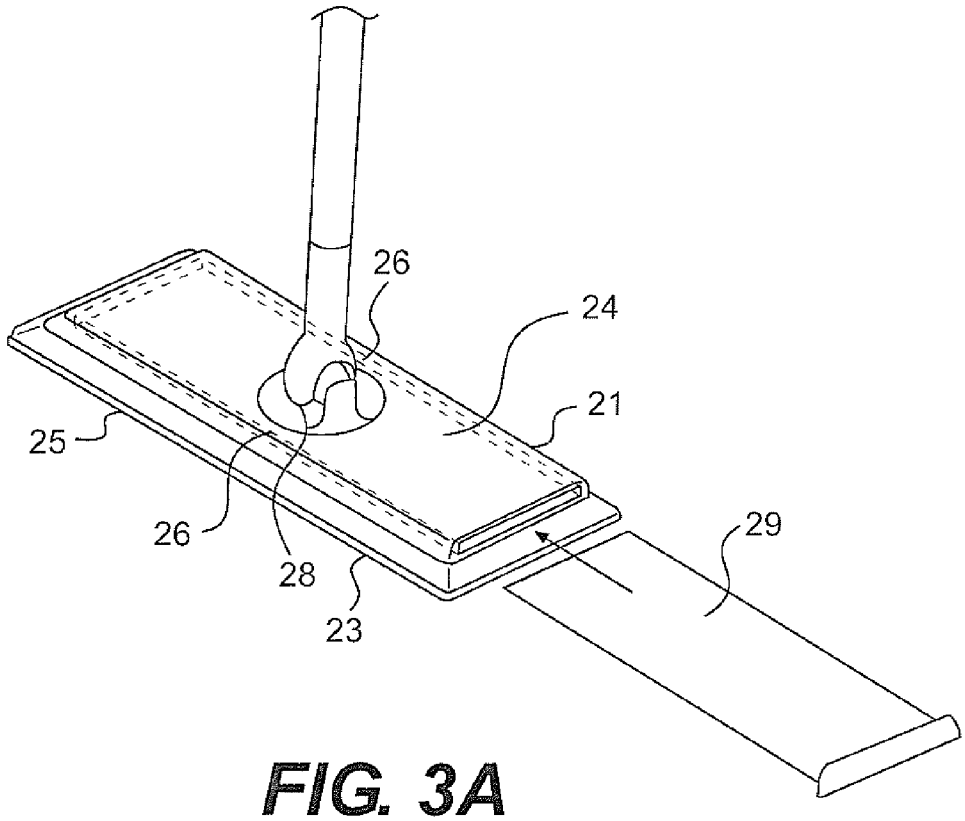
FIG. 3 is a perspective view of (A) a magnetic cartridge that can be easily removed and replaced and (B) a magnetic panel that may be lifted from the surface of the head to reduce the magnetic field directed to the cleaning surface of the head thereby releasing the magnetically susceptible particles from the cleaning sheet.
Figure 3B:
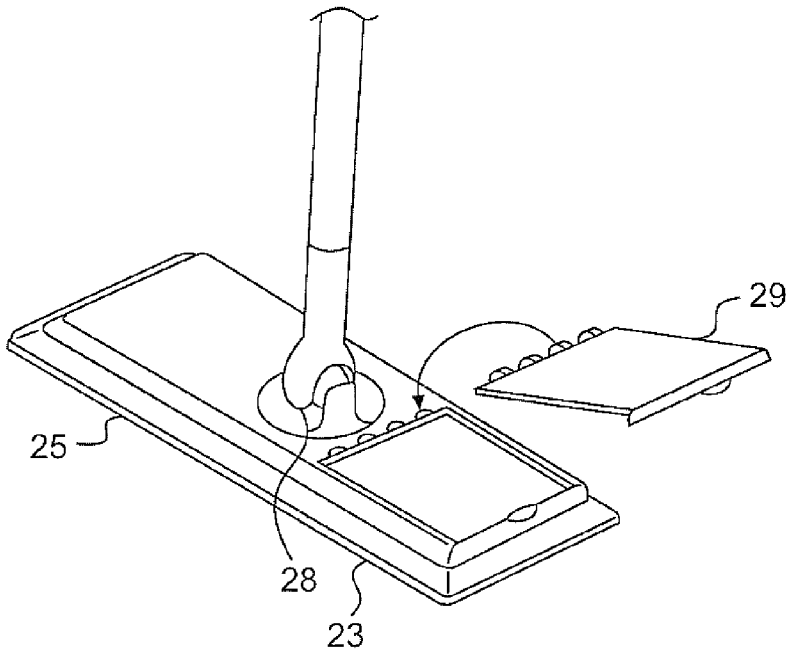

In a floor mop device configuration of this aspect of the present invention the handle is preferably affixed or connected to the head by a joint that permits the head to move while maintaining the lower cleaning surface flush with the floor see FIG. 2. In this aspect of the invention and similar to the other devices described, the head 24, has an upper surface 21, a lower surface 23 and a perimeter edge 25. It may be provided in a number of shapes based on the desires of the user, for example the head 19 may be rectangular, square, oval, round, egg-shaped or any combination, of any or all, of these shapes. Preferably the head 24 is provided in a generally rectangular shape, having a length of about 6 inches to about 36 inches, a width of about 2 inches to about 10 inches and a thickness of about ¼ inch to about 2 inches. The joint 28 may provide tilting capability or both tilting and rotational capability. When the joint 28 allows the head 24 to tilt in a two-dimensional plane the joint 28 may be a hinge. For example, the head 24 may comprise an adapter having two sides extending from and perpendicular to the upper surface of the head 21 one opposite the other each side having an aperture in line for receiving a hinge pin. The handle 22 further comprises an adapter insert with a single aperture to receive a hinge pin wherein the adapter insert fits snugly between the two sides of the adapter provided by the head 21. The hinge pin is inserted when the apertures of the adapter sides and the adapter insert are positioned in line thereby providing a joint 28 that allows tilting of the head during use. The adapter in the head 21 may be provided by form molding or may be affixed to the head 21 by for example screws or adhesive. If the adapter is provided for affixing to the head 21, it may be made of the same material as the head 21 or may be made of a different material. For example the head 21 may be made of form molded plastic and the adapter may be made of metal. Correspondingly, the adapter insert may be for molded with the handle 22 as a single piece or may be made for affixing to the handle 22. As with the adapter, the adapter insert may be made of the same material as the handle 22 or a different material. In other configurations the flexible means may be a tightly coiled spring or rubber shaft in line with the handle and affixed between the handle and the cleaning head that maintains its rigidity until a set desired angular pressure is applied allowing the spring to bend.

To provide both tilting and rotational capability the head and handle may be affixed or connected by a universal joint. A universal joint includes a first rotational joint having a shaft with an axis parallel to the longitudinal axis of the mop head and a second coplanar rotational joint having a shaft with an axis perpendicular to the longitudinal axis of the head. For example the end of the handle that is affixed to the head may have a U-shaped adapter with an aperture for receiving a pin wherein the aperture is provided perpendicular to the handle shaft. The head has a round snap fit aperture about the center of the upper surface. This aperture is able to receive the round snap fit base of an adapter such that when the adapter is positioned in place the adapter may rotate easily. An adapter insert is provided on and perpendicular to the upper surface of the head having an aperture about the center of the adapter insert that may be received by the U-shaped adapter of the handle. When the apertures are in line the pin may be placed in position completing assembly of the joint. Alternatively, the universal joint may be a ball joint wherein the end of the handle that connects to the head has a spherical member. The head has a split ball joint adapter able to receive the spherical member of the handle. The spherical member may be snapped into the split ball joint adapter or the adapter may provide a screw connection between the two sides of the split ball joint adapter so that the joint may be tightened to the desired rotational capability.

The magnetic means may be provided by a variety of methods such as for example a solid rigid magnet, or a flexible sheet magnet. Correspondingly, a magnetic field may be generated by an electrical current passed through a coil of wire. In one preferred embodiment the magnetic means is provided through the use of one or more solid magnets that may be affixed to the head such that they are flush with the lower surface of the head. Preferably indentations able to receive the magnets are provided in the head such that the magnets are flush with the lower surface. In this configuration the solid magnets may be affixed within these indentations by a variety of means such as snap fit or adhesive. These magnets are commercially available in a variety of shapes, sizes and strengths. Alternatively, they may be form molded into the head such that they are fully encased by the material used to construct the head and such that the desired magnetic field is exerted toward the surface being cleaned. In other configurations the one or more magnets may be provided on the perimeter edge of the head or may be positioned on the upper surface of the head in such a way that a desired magnetic filed is exerted toward the surface being cleaned.

In yet another configuration the solid rigid magnets may be housed within or affixed to one or more plates hingeably or rotatbly attached to the upper surface of the cleaning head in such proximity that the magnets exert the desired magnetic force to the lower surface of the cleaning head. In a preferred embodiment the magnets are affixed to the plates with an adhesive that allows the magnets to be removed and replaced as desired. During use the magnetic plate is maintained in position by a securing device such as a clip that keeps the plate flush against the upper surface of the cleaning head insuring the maximum magnetic force is applied to the lower surface of the cleaning head. When desired the plate is unclipped and pivoted away from the upper surface of the cleaning head substantially reducing the magnetic field about the lower surface of the cleaning head releasing the magnetically susceptible particles from the cleaning sheet. Depending on the desires of the user the cleaning head could have one or more of these magnetic plates hingeably attached to the upper surface of the cleaning head. The hinge or pivot point of the plate may be prepared in a configuration that allows the plate to be removed. In this configuration the magnets can be discarded and replaced if they loose strength or they can be changed to increase or decease the desired magnetic force applied by the device.

One skilled in the art would recognize that the number of magnets that may be used on any given head will depend on the size and shape of the head and the size, shape and strength of the magnets. One skilled in the art can determine the strength of the magnets to be used for effective and efficient cleaning by considering the distance between the magnetic and the magnetically susceptible dust and/or dirt, the volume of magnetically susceptible dust and/or dirt, the size of the cleaning surface of the head, the area of the lower surface of the head occupied by the one or more magnets and the positioning of the magnets in or on the cleaning head. For example, to utilize as much of the magnetic field generated by any particular magnet it is best to keep the distance between the magnet and the magnetically susceptible dust and/or dirt to a minimum. Consequently, it may be beneficial to have a portion of the magnet exposed as opposed to being encapsulated within the material used to construct the head. Alternatively, if it is desirable to encapsulate the magnets to protect the magnets from damage or corrosion a more powerful magnet may be selected to maintain the strength provided in the exposed magnet configuration.

If there is a large amount of magnetically susceptible dust and/or dirt to be captured it may be beneficial to provide a larger magnetic surface on the cleaning head. Correspondingly, if there is only small amount of magnetically susceptible dust and/or dirt the magnetic surface provided may be substantially smaller. Alternatively, if the magnets are placed in a matrix configuration at set distances from one another across the lower surface it may be beneficial to increase the size and/or shape of the head to provide additional magnets on the lower surface. Correspondingly, the distances between the magnets within the matrix may be adjusted to increase the active magnet surface area by decreasing the distances within the matrix, or decrease the active surface based on the needs of the user by increasing the distances within the matrix.

If a limited number of magnets are to be used in the cleaning head it would be important to position them in such a way as to assure the effectiveness of the device. In FIG. 2, for example, if only two magnets 29 are to be used it might be beneficial that they be rod shaped so that they may be positioned on the lower surface 23 about the middle, or along the leading perimeter edge 25, and generally parallel to length of the cleaning head 24.

In another preferred embodiment the magnetic means is a flexible magnetic panel or sheet see FIG. 1. With this type of magnetic means 13 the panel may be cut to a desired dimension and affixed to the lower surface 18 of the cleaning head 19. Preferably there is an indentation or recess in the lower surface 18 of the head 19 to receive the flexible magnetic panel or sheet 13. Preferably the magnet 13 is cut in the same shape and size as the lower surface of the cleaning head 19. Alternatively, the sheet may be cut into strips wherein two or more strips can be applied to the lower surface of the cleaning head. The sheet magnet may be affixed to the head by a variety of methods such as by magnetic attraction, adhesive or screwing. If magnetic attraction is preferred a metallic surface may be provided on, or within, the cleaning head to allow affixing of the sheet magnet to the lower surface. If adhesive is preferred it may provided in such a way to allow the magnetic sheet to be removed and replaced.

In another configuration the cleaning head may have a cavity to receive a removable magnetic sheet. The cavity may have guides along its sides to assure that the magnetic sheet is properly positioned within the cleaning head. In this configuration the magnetic sheet may be carried platform, the sides of which interface with the guides and on which the magnetic sheet can be affixed. In a preferred embodiment the magnetic sheet is affixed with an adhesive that allows the magnetic sheet to be removed and replaced when desired. Preferably the magnetic sheet is about the length and width of the cleaning head so that the magnetic force applied by the lower surface to the area being cleaned is maximized. However, one or more magnetic sheets could be used and positioned side-by-side or stacked if desired. In a preferred embodiment the magnetic sheet is secured in place with a mechanism similarly used in digital cameras to maintain the imagine storing chip. By pressing the chip into the cavity it is locked in position. A second push releases the chip for removal. In this configuration as with the hingeably attached magnetic plate, the magnetic sheet can be discarded and replaced if it looses strength or it may be changed to increase or decease the desired magnetic force applied by the device.

In each of the magnetic means described thus far a cleaning sheet is applied over the lower surface and affixed to the head during proper use.

In yet another preferred embodiment of the present invention the magnetic thread(s) may be woven into adhered to or bonded to the cleaning sheets. The number of threads provided in a cleaning sheet may be adjusted to a higher number to increase or to a lower number to decrease the active magnetic surface area based on the needs of the user.

Preferred sheets that are suitable for use with the present invention are more fully described in U.S. Pat. Nos. 6,645,604 and 6,561,354 both of which are incorporated herein by reference. The sheets in these application preferably comprise two components: a polymeric net or scrim and a fibrous material which is laid upon the scrim by lamination via heat or chemical means such as adhesives or by hydrogen entanglement. Scrim materials useful herein are described in U.S. Pat. No. 4,636,419, which is incorporated herein by reference. The scrims may be formed directly at the extrusion die or can be derived from extruded films by fibrillation or by embossment, followed by stretching and splitting. The scrim may be derived from polyolefin such as polyethylene or polypropylene, copolymers thereof, poly(butylene terephthalate), polyethylene terephthalate, Nylon 6, Nylon 66 and the like. Scrim materials are available from a variety of commercial sources such as Conwed Plastics (Minneapolis, Minn.).

Materials particularly suitable for forming the fibrous material of the sheet include for example natural cellulosics, as well as synthetics such as polyolefins (e.g. polyethylene and polypropylene), polyesters, polyamides, synthetic cellulosics (e.g. Rayon, and blends thereof. Also useful are natural fibers, such as cotton, or blends thereof and those derived from various cellulosic sources. The material, weave or matrix selected by the user will be based on the characteristics of the material that allow for capture of larger particles drawing them preferably off the cleaned surface onto the magnet of the head to prevent scratching. In one configuration the magnets are positioned in the head a desired distance from the surface to be cleaned such that when capturing larger particles of dirt and/or dust they are drawn away from the cleaned surface into the cleaning sheet and to the magnets thereby preventing the particles from scratching the cleaned surface. Preferred starting materials for making the hydrogentangled fibrous sheets of the present invention are synthetic materials which may be in the form of carded, or spunbouned meltblown, airlaid, or other structures. Particularly preferred are polyesters, especially carded polyester fiber. The degree of hydrophobicity or hydrophilicity of the fibers is optimized depending upon the desired goal of the sheet, either in terms of type of soil to be removed, the type of additive that is provided, when the additive is present, biodegradability, availability, and combinations of such considerations. In general, the more biodegradable materials are hydrophilic, but the more effective materials tend to be hydrophobic.

There are a variety of attachment means that may be utilized for affixing the cleaning sheet to the head such as by direct pressure provided by for example a clamp or by frictional pressure provided by for example Velcro™. Alternatively, a cleaning sheet may be affixed by use of a pin or by a pressure grip such as that described in U.S. Pat. No. 6,305,046.

If the attachment means is a clamp the clamp may be activated by pressure applied in a similar fashion as a pressure clip commercially used to hold a pad in a notebook. It may be a spring activated similar to a clothes pin or a pressure band activated similar to the triangular binder clips available commercially for holding stacks of paper together. The clamp may be affixed to the cleaning head by a variety of means. For example an adapter may be form molded into the head to receive the clamp by snap or press fitting Alternatively the clamp may be screwed onto the head or adhered by adhesive to the head. The clamping means may also be a magnet see FIG. 2. In this configuration the portion of the head to which the cleaning sheet is attached must be magnetically susceptible to provide a surface to attract the magnet 26. The surface may be form molded into the cleaning head 24, screwed to the head 24 or adhered to the head 24 with adhesive. Alternatively, the magnets positioned within the head may be provided with sufficient magnetic strength to allow the magnetic clamp 26 to be affixed to the upper surface of the head 21 without the addition of a magnetically susceptible metallic surface.

If the attachment means functions by frictional pressure it may be a serrated edge, Velcro™ or by pressure grip. If the attachment means is a serrated edge such as for example a serrated metal strip. In this configuration a strip may be provided on each of two sides of the head opposite each other by a variety of methods such as by screw or adhesive. These may be oriented at such an angle that one edge of the cleaning sheet may be snagged on one side of the head wrapped around the lower surface of the head and the opposite edge of the cleaning sheet snagged on the other side of the head. If the attachment means is Velcro™ the hook portion of the Velcro™ may be provided on the head while the cleaning sheet may be made of a fibrous material, that can be captured by the hook portion such as a felt. The hook portion of the Velcro™ may be affixed to the cleaning head by a variety of means but preferably by adhesive. A pressure grip attachment means is described in U.S. Pat. No. 6,305,046 and is incorporated herein by reference in its entirety.

The attachment means may be mechanical such as one or more snaps. In this configuration the cleaning sheet may be clamped between the male and female portions of each snap. Alternatively the sheet may be provided with holes to avoid clamping of the sheet between the male and female portions of the snap. The snaps may be affixed to the cleaning head by a variety of methods, preferably by rivet or by form molding into or as part of the head. Alternatively, the attachment means may be one or more dowels that when inserted into their corresponding pressure fit apertures over the cleaning sheet clamp the sheet onto the head. In this configuration the pressure fit apertures are provided in the desired surface of the head to effectively affix the cleaning sheet to the lower surface of the head.

Prior to use the user selects the appropriate cleaning device of the present invention based on the surface to be cleaned, for example if the surface to be cleaned is a table or countertop the appropriate device might be a handheld duster, correspondingly if the surface to cleaned is a floor a mop might be appropriate.

Next the user determines the general magnetic strength required to accommodate the volume of magnetically susceptible dust and/or dirt to be removed from the surface. For example if the volume is large volume or the particle size is greater than construction grade sand a large magnetic surface area may be desirable. Correspondingly, the strength of the field generated by the magnetic surface should be sufficient to capture and maintain those sized particles on the surface of the cleaning sheet.

Next the user may determine the cleaning sheet to be applied to the device based on the amount, type and general size of the dust and/or dirt to be captured, collected or retained by the sheet. If for example there is a large amount of dust and/or dirt to be removed from a surface a sheet having the appropriate three-dimensional surface texturing to collect a large volume of dust and/or dirt may be appropriate.

Once the device configuration, either duster or mop has been selected having the appropriate magnetic means and the cleaning sheet having sufficient characteristics is selected, the cleaning sheet must be attached to the head of the device such that it sufficiently covers the lower surface. The method for attaching the sheet to the cleaning head will depend on the type of attachment means provided on the head. If for example the head provides clamps on the front and back perimeter edges of the cleaning head, then one end of the sheet is inserted into the jaws of the first clamp and secured. The sheet is then stretched across the lower surface of the cleaning head and the opposite end of the sheet is inserted into the jaws of the second clamp and secured. Preferably the sheet is held tightly and generally taut across the lower surface of the cleaning head. If the head provides snaps on the upper surface of the cleaning head, preferably about four snaps positioned one in each corner of the head, then each of the four corners of the sheet may be snapped into each of the four snaps. Preferably the sheet is held tightly and generally taut across the lower surface of the cleaning head. If for example the head provides pressure grips such as those described in U.S. Pat. No. 6,305,046 on the upper surface of the cleaning head, preferably about four, one in each corner of the upper surface, then the sheet is placed over the pressure grips and pressed into each cavity such that the ends of the sheet do not enter the cavity. Preferably the sheet is held taut across the lower surface during this procedure to assure that it maintains its tautness after being attached to the cleaning head.

Once the cleaning sheet is in place the user may begin cleaning the surface. When the cleaning sheet has gathered a sufficient amount of dust and/or dirt the sheet is removed and discarded and another sheet is positioned in place. If the device selected for use comprises the magnetic means it would be beneficial to remove the used cleaning sheet over a trash can or receptacle to avoid the magnetically susceptible particle from falling to the clean floor once removed from the magnetic means of the cleaning head. Alternatively, the sheet may be removed by first releasing its edges from the attachment means, folding the edges over the used surface and slowly removing the sheet from the magnetic means for disposal.

What is claimed is:

1. A device for cleaning surfaces comprising:

a housing having a handle on one end and a cleaning head on the other end said cleaning head having an upper surface, a lower surface, a perimeter edge and a magnetic means said magnetic means being removably attached to said cleaning head and providing a magnetic field to at least said lower surface of said cleaning head; and at least one attachment means provided on said upper surface or said perimeter for securing a cleaning sheet over said lower surface of said cleaning head;

wherein said magnetic means is hingeably attached to said cleaning head.

2. A device according to claim 1 wherein said magnetic means is at least one rigid magnet or a flexible magnetic sheet.

3. A device according to claim 2 wherein said at least one rigid magnet is pivotally attached to said upper surface.

4. A device according to claim 2 wherein said at least one rigid magnet is hingeably attached to said upper surface.

5. A device according to claim 1 wherein said housing further comprises a flexible means between said handle and said cleaning head that allows said cleaning head to pivot about the handle.

6. A device according to claim 5 wherein said flexible means is comprised of a universal joint and a rotational joint.

7. A device according to claim 1 wherein said attachment means functions by way of direct pressure.

8. A device according to claim 7 wherein said attachment means is a clamp.

9. A device according to claim 8 wherein said clamp is activated by a spring or a magnet.

10. A device according to claim 8 wherein said clamp is a snap.

11. A device according to claim 1 wherein said attachment means functions by way of frictional pressure.

12. A device according to claim 11 wherein said attachment in cans are hook and loop fasteners, at least one serrated strip or at least one pressure grip.

* * * * *